United States Patent [19]

Hubbard et al.

[11] Patent Number: 4,858,525

[45] Date of Patent: Aug. 22, 1989

[54] POSTAGE METER HAVING A WORM GEAR DRIVE AND GUIDING SLEEVE

[75] Inventors: David W. Hubbard, Stamford; Glen J. Randmer, Norwalk, both of Conn.

[73] Assignee: Pitney Bowes Inc., Stamford, Conn.

[21] Appl. No.: 130,041

[22] Filed: Dec. 7, 1987

[51] Int. Cl.[4] ..... B41J 1/20; B41J 1/34

[52] U.S. Cl. ..... 101/91; 101/110; 74/424.8 R

[58] Field of Search ..... 101/91, 92, 110, 111; 74/424.8 R

[56] References Cited

U.S. PATENT DOCUMENTS

| | | | |
|---|---|---|---|
| 3,453,952 | 7/1969 | Huber | 101/110 |
| 3,589,281 | 6/1971 | Woodhead | 101/110 |
| 4,121,473 | 10/1978 | Schubert et al. | 74/89.15 |
| 4,221,135 | 9/1980 | Schubert | 74/29 |
| 4,350,092 | 9/1982 | Geney | 101/110 |
| 4,367,676 | 1/1983 | Clark | 101/91 |
| 4,398,458 | 8/1983 | Denzin et al. | 101/91 |
| 4,408,524 | 10/1983 | Nuckel et al. | 101/110 |
| 4,603,627 | 8/1986 | Pollak, Jr. et al. | 101/91 |
| 4,604,950 | 12/1986 | Sehe | 101/110 |
| 4,672,858 | 6/1987 | Langowski | 74/424.8 R |
| 4,709,630 | 12/1987 | Wilkins | 101/110 |

*Primary Examiner*—William Pieprz

*Attorney, Agent, or Firm*—Peter Vrahotes; Melvin J. Scolnick; David E. Pitchenik

[57] ABSTRACT

This invention relates to a postage meter having a plurality of worm gears for adjusting the rotational position of postage print wheels. Each worm gear selectively moves a rack which is an engagement with a postage print wheel so as to provide rotational movement to the print wheel. Sensors are provided so that the rotational position of each worm gear can be determined thereby indicating the position of the print wheels. A sleeve is located within the housing to provide support to the worm gears and maintain alignment of the racks during printing.

6 Claims, 6 Drawing Sheets

POSTAGE METER HAVING A WORM GEAR DRIVE AND GUIDING SLEEVE

BACKGROUND OF THE INVENTION

Postage meters are devices for dispensing value in the form of postage printed upon a mail piece such as an envelope. The postage meter has the ability to record the amount of postage printed by the meter in a secure manner. The term postage meter also includes meters such as parcel post meters and tax stamp meters. Contemporary postage meters have print wheels with print elements in the form of font characters representing values of zero through nine located about the perimeter thereof that are used to print the postage. With four print wheels, the print wheels can be independently positioned to allow a user to set any amount of postage between $00.00 (for test purposes) to $99.99. As a mail piece is placed into position, the print wheels are inked and then are driven into contact with the mail piece to imprint postage thereon. Obviously, the print wheels must be selectively adjusted as required to assure the proper amount of postage is printed. For this purpose, each print wheel is rotatably supported within the postage meter and has a setting mechanism associated therewith such as a coaxial gear integral therewith or secured thereto. A device, such as a rack, engages the gear of the print wheel at one of its ends, and at its opposite end, the rack is engaged by another gear that is driven by either a motor or a lever in the case of manual setting. With such arrangements, there is a relatively large number of gears and levers located between the print wheels and the source of power.

U.S. Pat. No. 3,978,457 to Check et al, filed Dec. 23, 1974, describes an electronic postage meter in which the printing and value setting mechanism are electronically controlled. Each print wheel is set to position a different postage amount by an independently rotatable gear mechanism. The gear mechanisms are engaged by a master gear one at a time, a master gear being rotatably mounted within a laterally movable carriage. The carriage can be moved to cause the master gear to engage in turn with the gear mechanisms. The carriage is positioned by a pair of solenoids acting through a variable linkage and the master gear is driven by a stepper motor. The print drum is driven by a separate motor. An electronic control system is fully described for operating the value setting and printing mechanisms in correct sequence in accordance with values selected by inputting through a keyboard. It will also be noted that the meter may be detachably mounted on a base containing certain mechanical drives although the drives for the setting mechanism are contained in the meter itself.

U.S. Pat. No. 4,050,374 to Check, filed June 21, 1976, describes a setting mechanism for a postage meter similar to that employed in the meter of earlier U.S. Pat. No. 3,978,457 in which the solenoids for positioning the master gear carriage are replaced by a stepper motor. U.S. Pat. No. 4,050,374 also describes a mechanism for locking the print drum against rotation during value setting. Further aspects and alternatives to the setting mechanism of such postal meter systems are disclosed in U.S. Pat. Nos. 3,965,815 and 3,977,320 to Lupkis et al.

U.S. Pat. No. 4,287,825 to Eckert, Jr. et al, filed Oct. 30, 1979 discloses a setting mechanism like that in U.S. Pat. No. 4,050,374 referred to above with a modified locking mechanism for the print drum during value selection.

U.S. Pat. No. 4,367,676 to Clark, filed May 22, 1981, describes a different approach to value setting. Here a bank of value setting gears equal to the number of print wheels is drivingly connected to respective print wheels one at a time to set the print wheels. A pinion rotated by a stepper motor is shifted from setting gear to setting gear by a tracking mechanism driven by a separate motor which also rotates the print drum at the same time.

U.S. Pat. No. 4,140,055 to Lellemand filed June 6, 1977 discloses a print wheel value changing system using a planet wheel transmission device in which an eccentrically mounted pinion meshes with a ring gear within a postage printing drum which supports the postage printing wheel.

Also of interest in this area are U.S. Pat. Nos. 3,965,815 and 3,977,320 which relate to electromechanical setting mechanisms for rotary drum postage meters. Other patents of general interest include U.S. Pat. Nos. 3,876,870; 3,890,491; 3,892,355; 3,916,361 and 3,949,203 issued to Malavazos et al.

Although the prior postage meter value setting schemes worked well, there have been shortcomings in terms of efficiency, economy and noise. Because of the many parts of the drive train provided to adjust the radial location of the print wheels, there was a tolerance build up. As is known, when two gears engage one another, the teeth of the gears must be precisely located, otherwise a stripping of the gears could result. In postage meters this is even of greater necessity because the location of the print wheels must be precise in order to determine the amount of postage being printed. For this reason, great measures are taken to assure that the drive train is accurately driven. With the many parts of a drive train now in existence, one is faced with the problem of tolerance build up. More specifically, each part and its interaction with another part involves a certain tolerance. When there are large numbers of parts that are interconnected to one another, there is a build up of tolerances. As one proceeds from one end of the drive train to the other, each component contributes its particular tolerance to the overall building of tolerances. For this reason, it would be advantageous to reduce the number of parts in a postage meter print wheel drive train. Another problem is encountered when the gear teeth do not mesh accurately; noise results when the gears are actuated to drive the print wheels.

It obviously would be desirable to provide a drive train for a postage meter that has few parts, operates more quietly, and yet provides the security and accuracy required in a postage meter.

SUMMARY OF THE INVENTION

The present invention embodies various improvements to postage meters generally and particularly to the printing mechanisms therefor. A novel system has been conceived for the setting of the postage value amounts in postage meters and for driving and operating the meter. The system includes, inter alia, a novel approach to moving the racks which control the value selection for printing on a mailpiece by the postage meter, particularly a system of the type having axially displaceable setting racks.

It has been found that using a worm gear drive for selectively rotating the print wheels of a postage meter for the purpose of setting the postage amount results in an advantageous advancement over the art. This advantageous advancement is achieved because the drive train has fewer and less complicated parts.

In the instant invention, each rack has a follower secured thereto that extends outwardly to be received within the helical thread of a worm gear that is connected to a drive motor. The rack also engages the gear of the print wheel so that as the rack is moved linearly, the print wheel will be rotated to a selected rotational position as is known in the art. As the worm gear is rotated, the follower will follow the profile of the threads of the helix in the worm gear thereby driving the rack linearly. A drive motor is connected to each worm gear through a belt drive to provide rotational drive thereto, and extending from the worm gear is an encoding disk that allows determination of the rotational position of the worm gear. As fabricated, with each 360° rotation of the worm gear, the print wheel will be rotated one increment, or unit, for example, from "0" to "1". As a consequence, upon rotation of the worm gear, it can be determined exactly where the print wheel is in terms of its rotational location.

A sleeve is provided to prevent the racks from becoming dislodged during the printing operation. When postage is to be printed, the print drum is rotated and the racks are rotated therewith. During such rotation there is a tendency for the racks to move but with the sleeve receiving the followers of the racks, movement of the racks is prevented.

DETAILED DESCRIPTION OF THE PREFERRED EMBODIMENT

Figure 1:
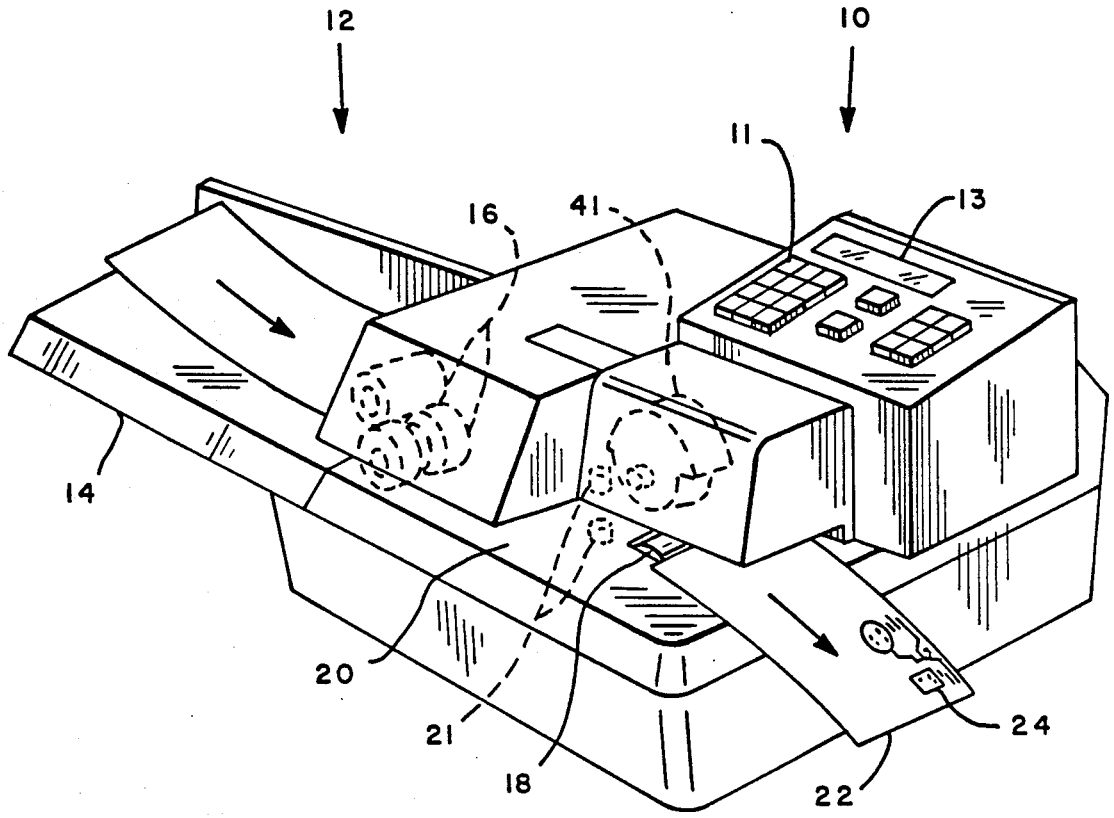
FIG. 1 shows a perspective view of the combination of a mailing machine and a postage meter in which the invention can be practiced.

Referring initially to FIG. 1, a postage meter is shown generally at 10, the postage meter having a keyboard 11 and a display 13. The postage meter 10 is shown as it is attached to a mailing machine 12 which mailing machine has an envelope feeder portion 14 with rollers 16. Another roller 18 is received within a platform 20 portion of the mailing machine 12, the rollers 16 and 18 being provided to convey mail pieces 22 across the mailing machine 12 for the purpose of having the meter 10 print postage indicia 24 upon the mail pieces. Located upstream from the roller 18 is a sensing device 21 that senses the leading edge of an envelope 22 that is transported by the rollers 16. This sensing device 21 may be a light-detector combination supported by the postage meter 10 and mailing machine 12. Although the invention will be described as it may be utilized in a postage meter of the rotary drum type, it will be appreciated that the principles of the instant invention will apply to other types of postage meters such as flatbed, reciprocating postage meters as well.

With reference now to FIGS. 2–6, the mailing machine 12 includes a housing 26 having an opening 30 therein. Supported within the mailing machine 12 is a motor (not shown) and a gear 28 is attached to the output shaft of the motor, which gear 28 extends through the opening 30. This combination of motor and gear 28 provides drive to the postage meter 10 as will be explained hereinafter.

Figure 2:
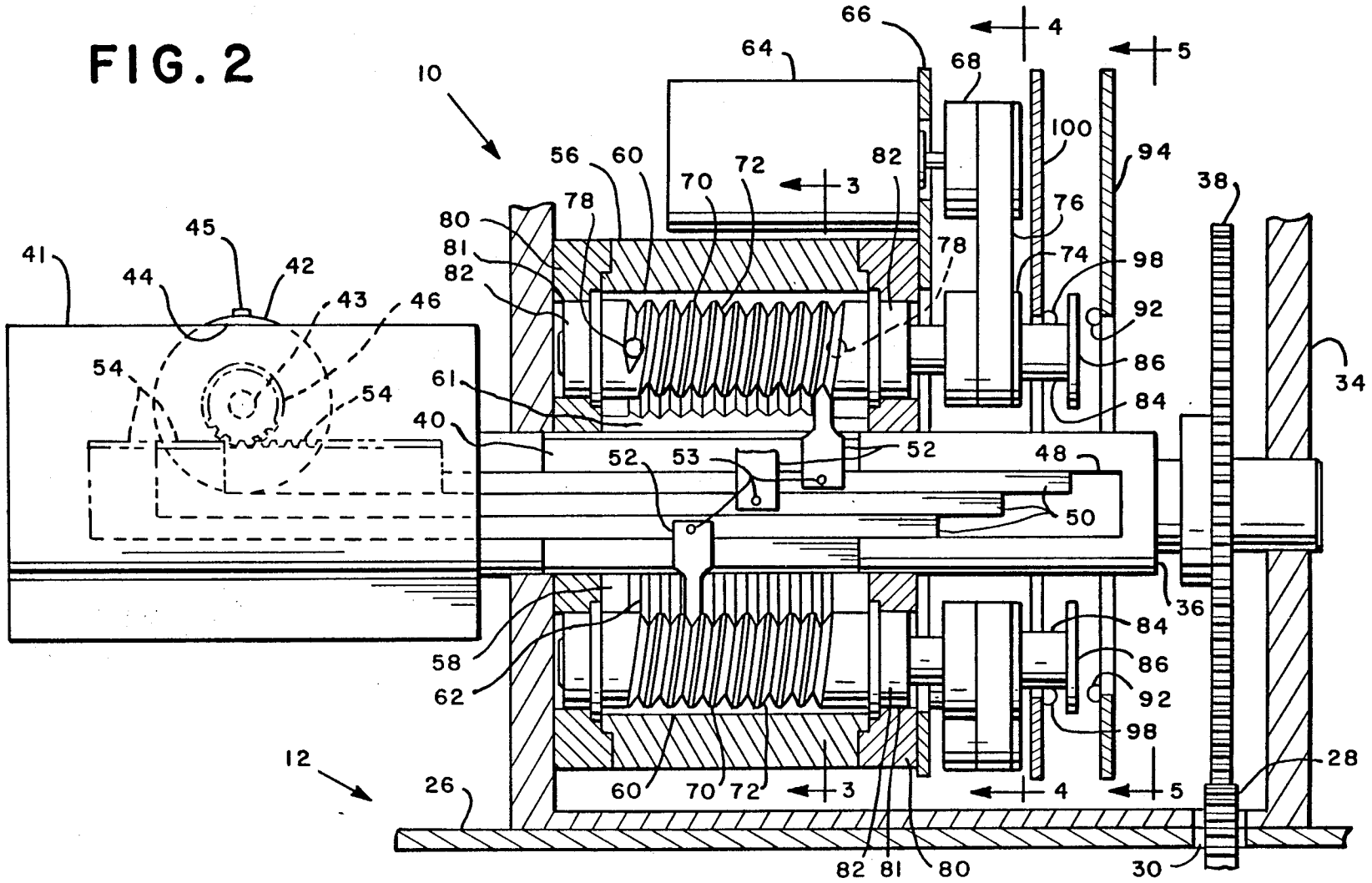
FIG. 2 shows a cross sectional view of the postage meter and a portion of the mailing machine.
Figure 3:
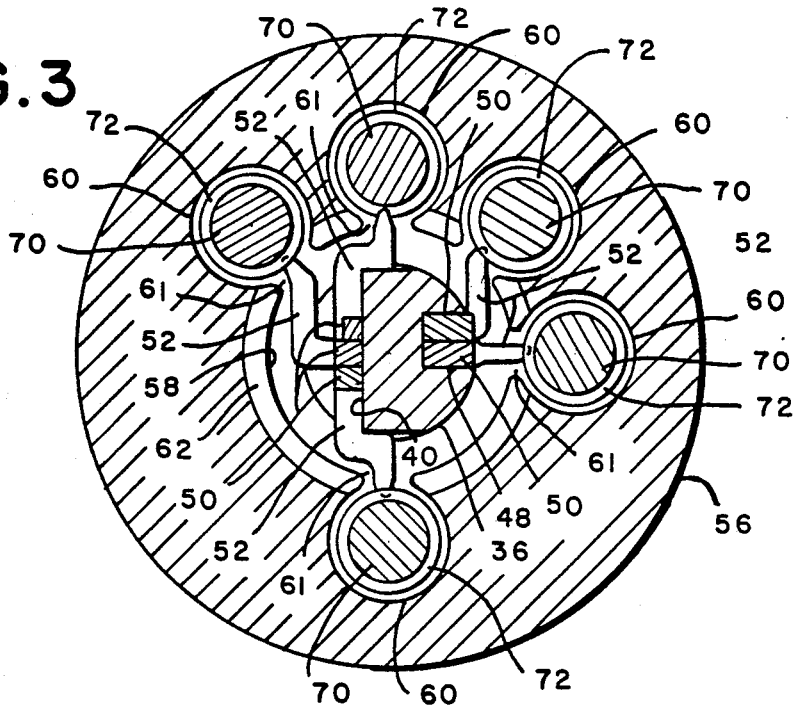
FIG. 3 shows a cross sectional view of the postage meter shown in FIG. 1 taken along the lines 3—3 of FIG. 2.
Figure 4:
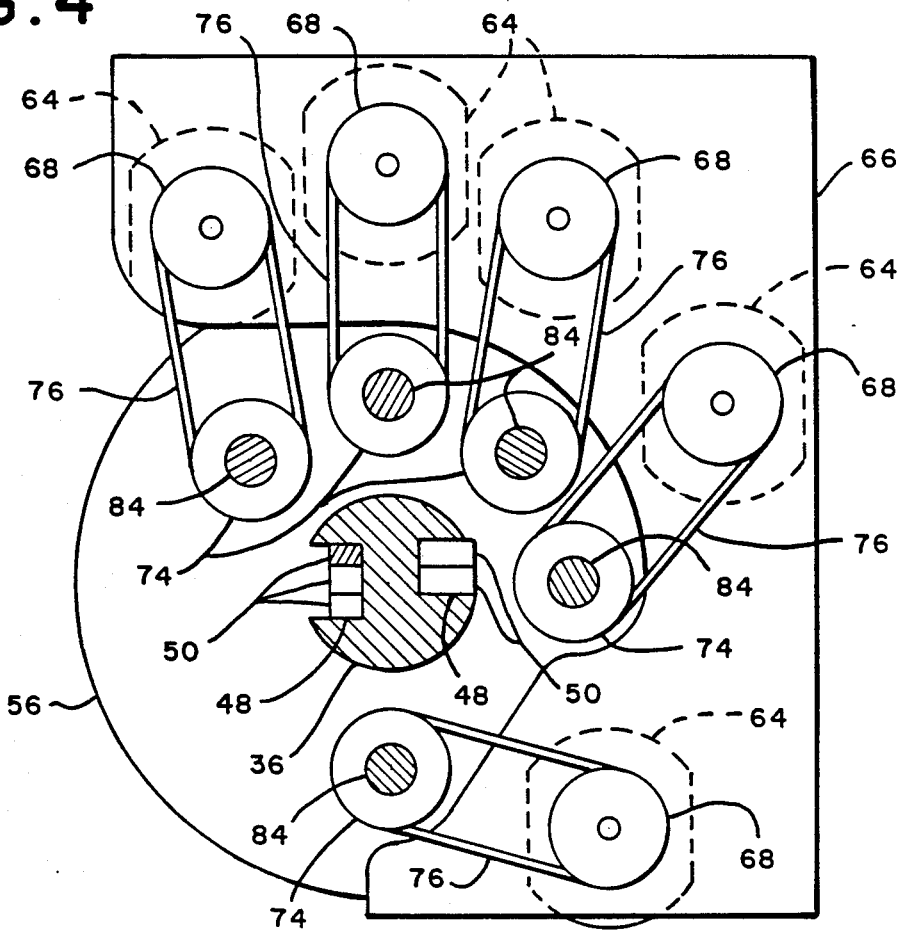
FIG. 4 shows a cross sectional view of the postage meter of FIG. 1 taken along the lines 4—4 of FIG. 2.

The postage meter 10 has a housing 34, only a portion of which is shown in FIG. 2, that rotatably supports a shaft 36 therein, which shaft has a cut-out, flatened portion 40. It will be appreciated that in the following description of the postage meter, a large number of components that are generally part of a postage meter are not included and will not be discussed since they do not form, nor are a necessary part of, the instant invention. Only those elements that are required for the printing of postage will be described, and those elements associated with recording the amount of postage printed, storing the mount of postage available, security, and functions not associated with the actual printing of postage indicia will be included in this description only to the extent necessary.

A meter drive gear 38 is mounted on the shaft 36 and meshes with the gear 28 of the mailing machine 12 so as to be driven thereby. A portion of the shaft 36 extends through the meter housing 34 and supported thereon is a rotary drum 41. This rotary drum 41 rotatably supports a plurality of value print elements in the form of print wheels 42 upon a shaft 43. These print wheels 42 are received within an opening 44 of the rotary drum 41 and extend beyond the perimeter of the drum 41.

Figure 7:
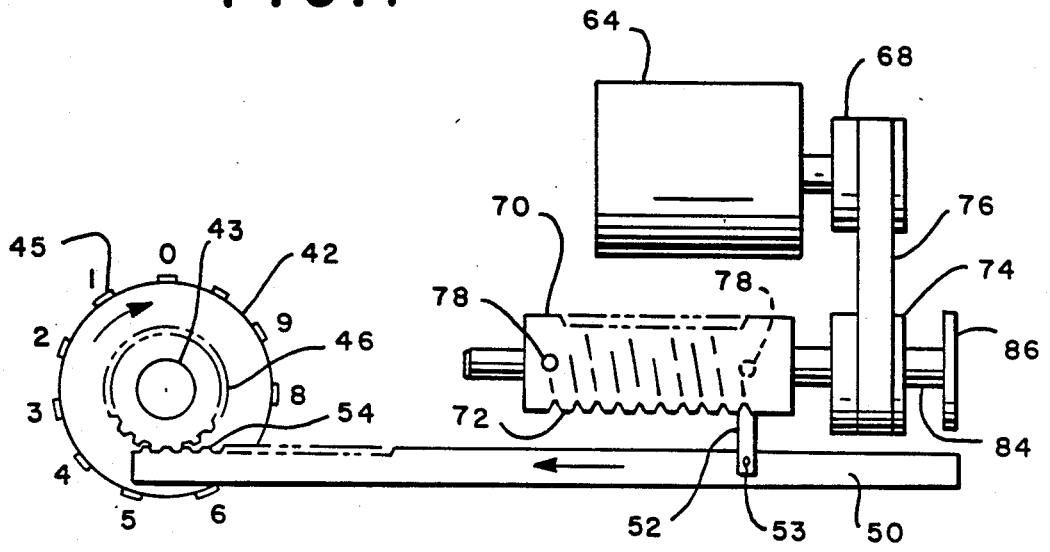
FIG. 7 shows a portion of the print wheel drive of the postage meter shown in FIG. 2 in greater detail.

The print wheels 42 have a plurality of fonts 45 forming numerical characters disposed about the perimeter thereof, the characters representing the denominations of 0–9 (see FIG. 7). Although a postage meter 10 will generally have from 3 to 5 print wheels, the instant invention will be described with a rotary drum 41 having five print wheels 42. It will be appreciated, however, that the principles of the invention can be applied to a postage meter having a smaller or larger number of print wheels without departing from the scope of the invention. Each of the print wheels 42 has a coaxial gear 46 integral therewith or attached thereto. The shaft 36 has two longitudinally extending slots 48 (see FIG. 4) one slot being located on one side of the shaft and three slots being located on the opposite side. One of these slots 48 receives three racks 50 and the other slot receives two racks (see FIGS. 3 and 4), each of the racks having a follower 52 secured thereto by a pin 53. A plurality of teeth 54 are located at the distal ends of the racks 50 which teeth mesh with the teeth of the print wheel gears 46. In this way, as a rack 50 is moved longitudinally, its associated print wheel 42 will be rotated about the shaft 43.

Disposed about the shaft 36 and supported within the housing 34 is a sleeve 56 having a larger, central longitudinally opening 58 therein and five smaller longitudinally openings 60 located about the central opening. Slots 61 are located between each small opening 60 and the large opening 58 to provide confluency. The larger opening 58 has a plurality of circumferential grooves 62 therein, adapted to receive the followers 52 when the followers are not located within the slots 61. Five DC motors 64 are secured to a plate 66 that is mounted within the housing 34 and each motor has a pulley 68 attached to its output shaft. Although DC motors are used in the preferred embodiment, it will be appreciated that other motors, such as stepper motors and AC motors, can also be used. Five worm gears 70 having helical threads 72 therein are received within the smaller openings 60 of the sleeve 56 and each worm gear has a pulley 74 attached at one of its ends. A belt 76 is trained about a motor pulley 68 and a respective worm gear pulley 74. By having the motors 64 positioned about the sleeve 56 and connected to the worm gears 70 through belts 76, a large number of print wheels can be accommodated.

Each of the worm gears 70 has a pair of pins 78 on opposite sides of the helical thread 72. Received within the thread 72 is a follower 52 of one of the racks 50, each follower extending from the central opening 58, through a slot 61 and into one of the smaller openings 60 when the worm gears 70 are in their rest positions. The pins 78 act as stops for the follower 52 thereby limiting the longitudinal direction of travel of its respective rack 50. More specifically, as a worm screw 70 is rotated, its associated follower 52 will be moved longitudinally by the helical thread 76 until it comes into contact with one of the pins 78. End caps 80 are located on opposite ends of the sleeve 56 and each receives five bearings 82 within openings 81 to facilitate rotation of the worm gears 70.

Each worm gear 70 has a shaft portion 84 integral therewith that supports a generally truncated encoding disk 86. Each encoding disk 86 has a large diameter portion 88 extending 180° about its perimeter, and a small diameter portion 90 that extends the other 180° thereabout (see FIG. 5). The large diameter portion 88 of each disk 86 is receivable between two lights 92 mounted on a board 94 and having electrical connections 96 and two photodetectors 98 also mounted on another board 100 having electrical leads 101 thereby allowing the photodetectors 98 to determine the presence or absence of the large diameter portion 88 of the disk 86 as the worm gear 70 is rotated by the motor 64.

Referring now to FIG. 10, a block diagram of the circuitry is shown for the drive of the motors 64 and sensing of the disks 86. The postage meter supports a microprocessor 102 therein such as an Intel 8086 microprocessor. As is known, the microprocessor of a postage meter performs two basic functions: performance of calculations based on input data for the printing of postage and controlling of the flow of data between various memory units. For the purpose of the description of the instant invention, only the necessary portion of the function of performance of data calculation will be considered. The microprocessor 102 receives postage data input from the keyboard 11 indicating the amount of postage to be printed. The microprocessor 102 will send a signal through an amplifier 104 to each motor 64 to cause sufficient drive to rotate the print wheels 42 the required amount. The photodetectors 98 will determine the amount of rotation of each print wheel and send print wheel location signals through line connections 101 to the microprocessor 102 by way of a line decoder driver 108 that properly sequences the incoming signals for transmission to the microprocessor. In this way a determination of the amount of postage set can be made. This amount will be shown on the display 13. Upon an envelope 22 being conveyed by the rollers 16,18 along the platform 20, the microprocessor 102 will then cause the motor of the mailing machine to be enabled to thereby print the postage by rotation of the print drum 41 through drive provided by the gear 38 and shaft 36. The postage printed will then be accounted for by the microprocessor 102 based upon the determination of the setting of the print wheels 42.

The setting of the print wheels 42 will now be described in greater detail. Upon an amount of postage being input through the keyboard 11 to the microprocessor 102, the DC motors 64 will be enabled so that the worm gears 70 are rotated a sufficient amount until the followers 52 reach their maximum position, to the left as shown in FIG. 2, and then the DC motor will be rotated in the opposite direction so that the followers 52 will reach their starting points, i.e. each follower will engage the stop 78 on the right as seen in FIG. 2. In such a position, the zero font will be located in a printing position, i.e. extending through the opening 44 of the drum 41, for each of the print wheels 42. In this way the exact position of the print wheels 42 is known immediately prior to the setting of the amount on the print wheels.

After the worm gears 70 are zero positioned as described above, the DC motors 64 will rotate each worm gear 70 in accordance with the postage amount input through the keyboard 11 so as to drive its associated rack 50 an appropriate distance in accordance with this input postage amount. Each rotation of the DC motor 64, and obviously of the worm gear 70, will result in the print wheel 42 being rotated one unit or font. More specifically, as the worm gear 70 is rotated 360° the print wheel 42 will rotate a sufficient amount to rotate the zero digit out of the opening 44 and expose the "1" digit. With another 360° rotation the "2" digit will be exposed, and so on until the 9th digit is exposed upon nine complete revolutions of the worm gear 70. Rotation of each print wheel 42 is accomplished through the rotation of a worm gear 70 under drive by its associated DC motor 64, and the follower 52 moving longitudinally by action of the helical thread 72, thereby carrying the rack 50 therewith. The teeth 54 of the racks 50 are in engagement with the gear 46 of the print wheels 42 and cause the print wheels 42 to rotate as the racks move linearly. After the print wheels 42 are set, the operator will supply an envelope 22 or envelopes to the rollers 16 so that such envelope is driven between the roller 18 and print drum 41. Upon this occurring, the sensor 21 will sense the leading edge of the envelope 22 and send a signal to the microprocessor 102 which will bring about rotation of the shaft 36 and drum 41 by enabling the motor of the mailing machine 12.

During the printing operation, the shaft 36 is rotated by action of the gear 34 being rotated by the mailing machine gear 28. As the shaft 36 is rotated it rotatably carries with it the racks 50, the flatened portion 40 providing room for the followers to be carried thereby. This tends to create undesirable longitudinal movement of the racks 50 and the followers 52 that are attached thereto. If there is misalignment of a follower 52 upon completion of rotation of the shaft 36, the follower would be in a different location from its original location and would tend to clash with the helical thread of its associated worm gear 70. More specifically, at the time the rotation starts, each follower 52 is received within the valley or root diameter of a thread and the rack teeth 54 mesh with the gear 46; whereas, upon completion of revolution the follower may be displaced so that the followers are located at the outside diameter or apex of the thread and the rack teeth and print wheel gear do not mesh. Obviously, this could cause considerable damage. To avoid this occurrence, the inner surface of the sleeve 56 has a plurality of grooves 62 preferably normal to the axis of rotation of the shaft 36. Each groove is aligned with a slot 61 and a valley or root diameter of the helical thread of the worm gear 70 so as to assure returning to the same location as before rotation. Thus, the sleeve 56 serves two functions: to support the shaft 36, worm gears 70 and their associated components and to prevent wander of the racks and followers 52 during rotation thereof.

Figure 5:
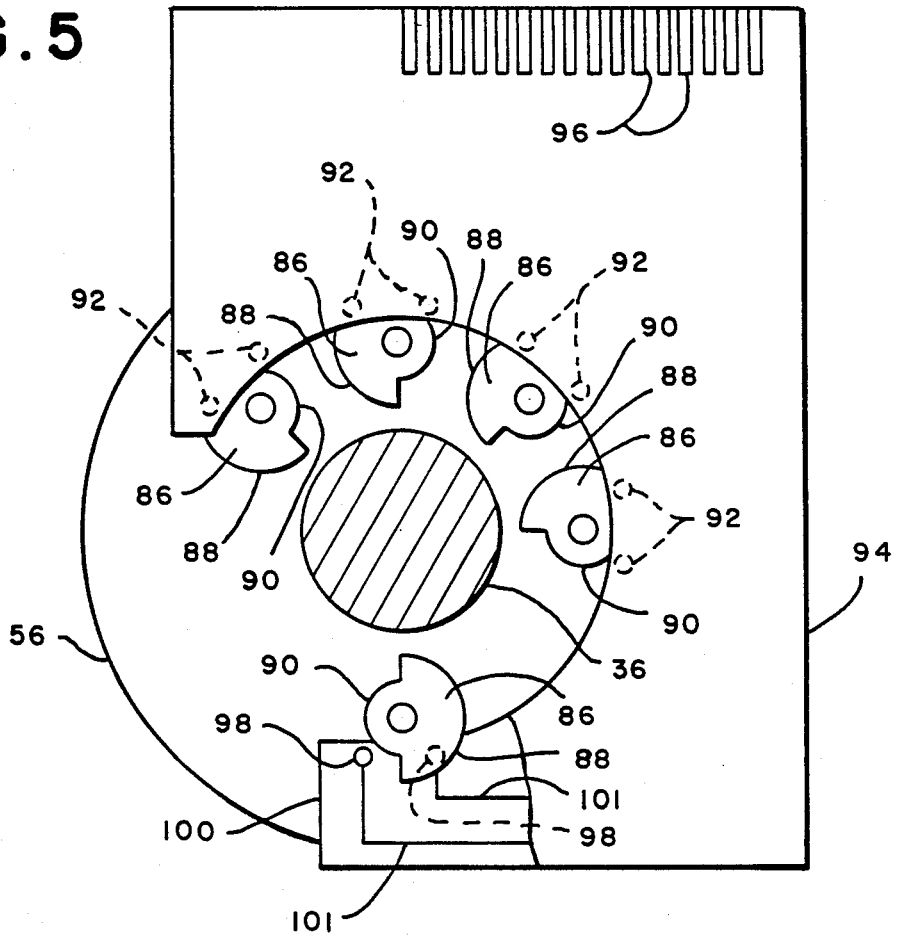
FIG. 5 shows a cross sectional view of the postage meter of FIG. 1 taken along the lines 5—5 of FIG. 2.
Figure 6:
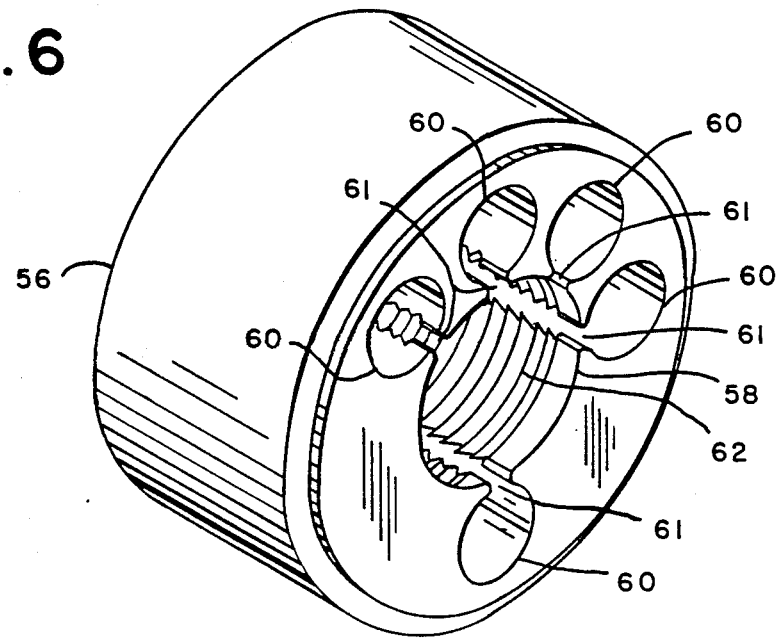
FIG. 6 shows a perspective view of the sleeve contained within the postage meter shown in FIG. 1 and 2.
Figure 8:
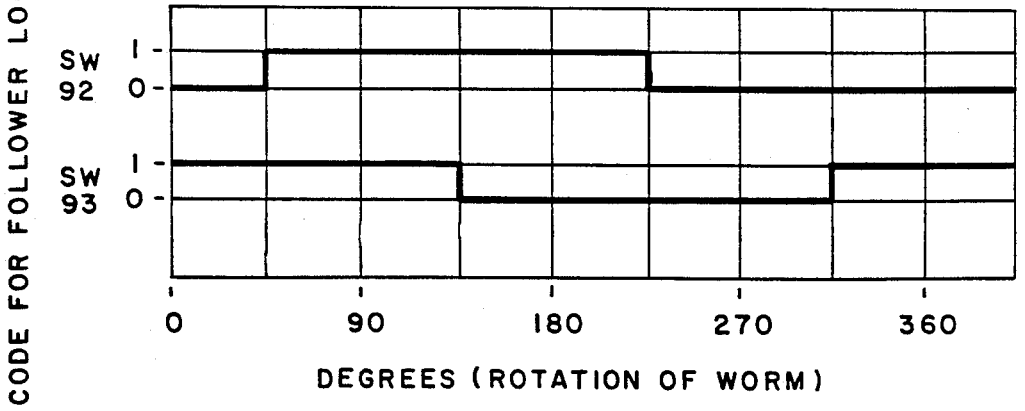
FIG. 8 is a graph showing the correlation between the location detectors and the rotation of the worm gear.
Figure 9:
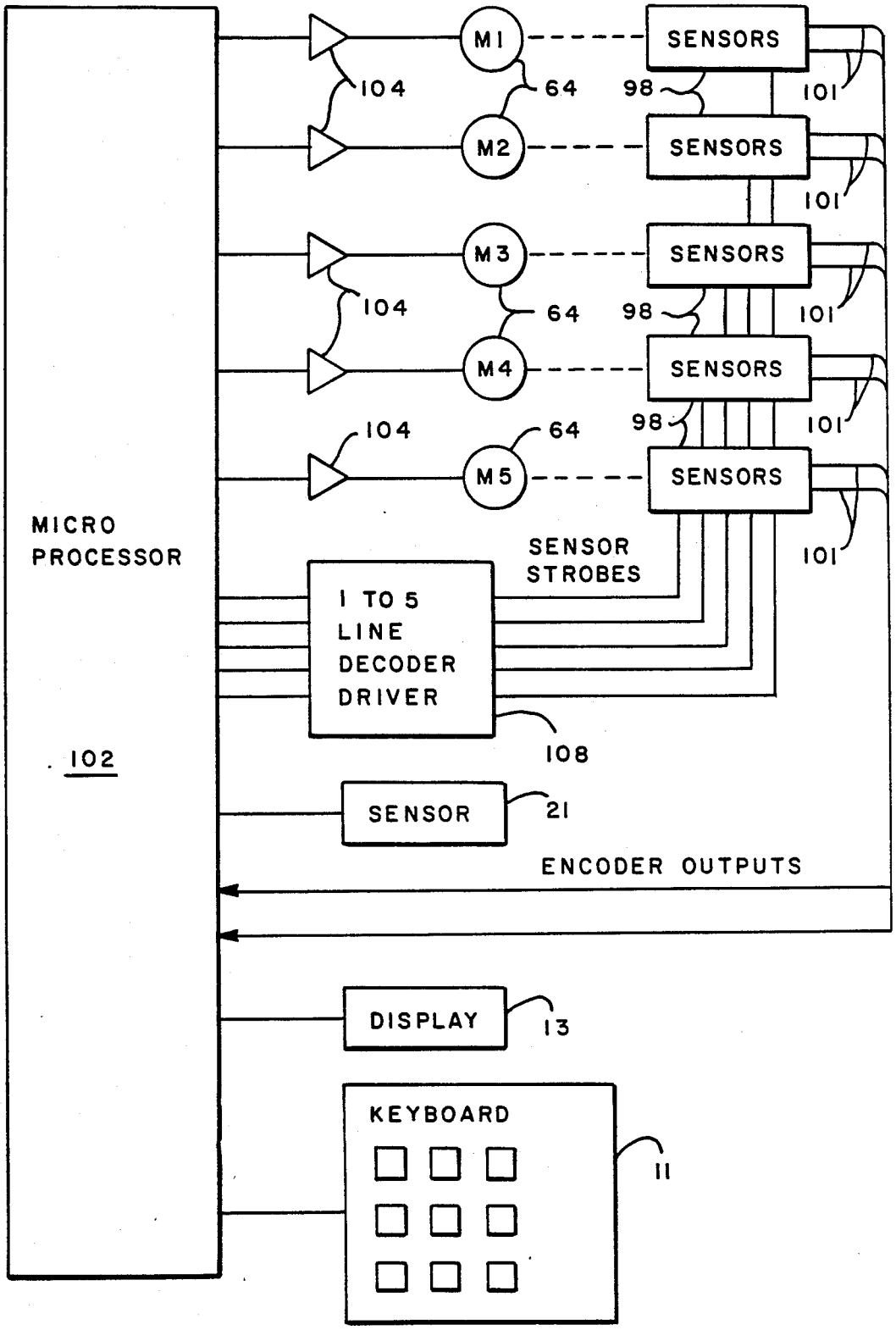
FIG. 9 is a block diagram showing a portion of the circuitry of the postage meter shown in FIG. 1.

During the time the output shaft of each motor 64 rotates to rotate the shaft portion 84 through the pulleys 68,74 and belt 76 to set the print wheels, the encoding disks 86 will be driven and the large diameter portions 88 of the encoding disks will move in and out of the space between the light 92, photosensor 98 combinations. By having two diameters 88,90, and two photodetectors 98 that are 90° apart relative to the axis of the disk 86, one is able to determine the posture of the worm gear 70 relative to its angular position within a 360° revolution. With reference to FIGS. 2, 5 and 8, when the worm gear 70 is at its home position, only one photodetector 98 will sense the disk 86. This yields a binary code. For example, no detection will represent the binary bit "0" and detection would represent the binary bit "1". Consequently, in the rest or home position, having only one photodetector 98 sensing the disk 86 will yield a binary number 01. As the worm gear 70 rotates 90°, both photodetectors 98 will sense the presence of the encoding disk 86. This will yield the binary number 11. As the encoding disk rotates another 90° the first photodetector 98 will sense the encoding disk 88, but the second photodetector will not, thereby yeilding the binary number 10. Obviously, after a rotation of 270°, the encoding disk will not be sensed by either of the two photodetectors 92 to yield the binary number 00 and then, finally, with a complete rotation of 360°, the second photodetector 98 will sense the encoding disk, but not the first photodetector to again yield the binary number 01. Thus, when the binary number 01 is present, it is known that a font is in the printing position. Digital signals are sent from the photodetector 98 to the microprocessor 102 to indicate the rotational posture of the worm gear 70. In this way, the angular position of each worm gear 70 can be ascertained and the number of rotations counted allowing the amount of postage that is to be printed to be determined by the microprocessor 102.

Consequently, what has been shown and described is a postage meter print wheel setting mechanism that greatly simplifies print wheel setting for the amount of postage to be printed. The tolerance built up and number of components are significantly reduced and the helix of the worm gear 74 assures accurate positioning of the racks 50 with a reduced amount of noise. Additionally, a sleeve is provided that allows simple construction and support of certain parts of the postage meter 10 while also preventing misalignment of critical components thereof. Additionally, by having the motors 64 disposed about the sleeve 56, a relatively large number of print wheels 42 can be accommodated.

What is claimed is:

1. A postage meter comprising:

a housing, a sleeve supported within said housing, said sleeve having a central opening, a plurality of peripheral grooves disposed about said central opening and a plurality of openings peripheral to and confluent with said central opening, a rotatable shaft received within said central opening, a print drum having an opening therein and secured to one end of said shaft for rotation therewith, a plurality of print wheels rotatably supported within said print drum, each of said print wheels having a portion extending through said print drum opening, each of said print wheels having a gear coaxially secured thereto, a plurality of racks received within said central opening and slidably supported within said shaft and individually engageable with one of said gears whereby upon linear movement of said rack said print wheels are rotated, a follower secured to each of said racks and extending from said central opening to one of said peripheral openings to be received within a respective groove of said sleeve upon rotation of said shaft, a plurality of worm gears each having a helical thread and being rotatably received within said peripheral openings of said sleeve, one of said followers being received within the helical thread of one of said worm gears, means for rotating said worm gears, and means for rotating said shaft within said central opening, and relative to said worm gears, whereby said followers will travel within their respective grooves upon rotation of said shaft to be guided by said grooves to return to their original position.

2. The postage meter of claim 1 including means for determining the rotational position of said worm gears.

3. The postage meter of claim 2 including means for determining the number of rotations said worm gears are driven by said rotating means.

4. The postage meter of claim 2 wherein said worm gear has a pair of pins located within the helix thereof, said follower being received within the thread of said helix intermediate said pins.

5. The postage meter of claim 1 wherein said means for rotating each of said worm gears is a d.c. motor.

6. The postage meter of claim 5 wherein said d.c. motors are supported by said housing about said sleeve and have a pulley attached to the output shaft thereof, each of said worm gears has a pulley attached thereto and a belt is trained about each d.c. motor pulley and its respective worm gear pulley.

* * * * *